US010149519B2

(12) United States Patent
Giles

(10) Patent No.: US 10,149,519 B2
(45) Date of Patent: Dec. 11, 2018

(54) DUAL ENGAGEMENT WATCH STRAP CONNECTOR

(71) Applicant: James Giles, Pomona, CA (US)

(72) Inventor: James Giles, Pomona, CA (US)

( * ) Notice: Subject to any disclaimer, the term of this patent is extended or adjusted under 35 U.S.C. 154(b) by 0 days.

(21) Appl. No.: 15/717,639

(22) Filed: Sep. 27, 2017

(65) Prior Publication Data

US 2018/0125179 A1 May 10, 2018

Related U.S. Application Data

(60) Provisional application No. 62/418,670, filed on Nov. 7, 2016.

(51) Int. Cl.
*A44C 5/16* (2006.01)
*A44C 5/14* (2006.01)

(52) U.S. Cl.
CPC ..... *A44C 5/16* (2013.01); *A44C 5/14* (2013.01); *Y10T 24/4718* (2015.01); *Y10T 24/4782* (2015.01)

(58) Field of Classification Search
CPC ..... A44C 5/16; A44C 5/14; G04B 37/1486; Y10T 24/4782; Y10T 24/4718
See application file for complete search history.

(56) References Cited

U.S. PATENT DOCUMENTS 4,266,326 A 5/1981 Hong
5,668,784 A * 9/1997 Iguchi ..... G04B 37/1486 224/164
5,943,302 A * 8/1999 Fanshaw ..... G04B 37/1486 368/276
2015/0282573 A1 10/2015 Dornhege

FOREIGN PATENT DOCUMENTS

JP 2010035797 A 2/2010

OTHER PUBLICATIONS

International Search Report & Written Opinion dated Jan. 22, 2018 from corresponding PCT Application No. PCT/US17/60020.

* cited by examiner

*Primary Examiner* — Robert Sandy
*Assistant Examiner* — Michael S Lee
(74) *Attorney, Agent, or Firm* — Innovation Capital Law Group, LLP; Vic Lin

(57) ABSTRACT

A wristwatch strap connector for engagement of either of a two piece watch band formed in two sections, or, a single piece watch band formed in a single section to a wristwatch case. The connectors are employed in pairs and each connector is adapted at a first end to engage one side of the watch band case. Once the connectors are engaged, a user can connect either a one piece or two piece watch band to the wristwatch.

12 Claims, 3 Drawing Sheets

DUAL ENGAGEMENT WATCH STRAP CONNECTOR

This application claims priority to U.S. Provisional Patent application Ser. No. 62/418,670, filed on Nov. 7, 2016, which is incorporated herein in its entirety by this reference thereto.

BACKGROUND OF THE INVENTION

1. Field of the Invention

The present invention relates, generally, to watch bands and their securement to the watch body. More particularly, the invention relates to a watch strap connector configured to allow easy removable engagement of either a two-piece strap or a single piece strap to a watch using the same strap connector for either configuration.

2. Prior Art

Wristwatches are conventionally sold with a watch band engaged to opposing sides of the watch case. These watch bands are adapted to engage around the wrist of the user and operatively hold the watch in operative positioning on the wrist of the user.

For many users a single band will suffice. However, for many other users, their wish to customize the aesthetics of the watch, or to permanently or temporarily add function to a watch, will cause them to seek out and purchase a new watch band. Sports and specialty watches, such as the CASIO GSHOCK wristwatch, can be enhanced for function by changing the factory watch band to a watch band having band-mounted functional components to enhance the overall function of the watch for the user.

Further, some wearers of watches wish to engage a new band for comfort or convenience and to alter the ornamental look of the wristwatch. Many users, however, have encountered shortcomings attempting the task of engaging new watch bands to the lugs of their wristwatch bodies. For users wishing to engage a two piece strap to a watch having a single piece strap, the connectors available to engage with the factory lugs and provide a pathway to engage a single piece strap are not configured to allow for a subsequent engagement to the watch of a two-piece strap. This is because single piece straps have two ends, and in an engagement with a watch, a single piece strap follows a serpentine path through two opposing connectors, and around the watch body to engage them. However, two-piece straps each have a first end which engages one lug of the watch body and do not traverse across the rear of the watch body in such a connection. Connectors for such two-piece straps to opposing sides of a wristwatch body are adapted only to engage to the first end of each of the two straps.

As a consequence, wristwatch owners who wish to easily change their watch band from a single piece strap to a two-piece strap are unable to do so without great effort involving disengaging the watch band connectors from the lugs extending from the watch body and engaging connectors configured for a two-piece wristwatch strap. Users of watches with two-piece straps engaged are presented with the same problem in that they must change the band connectors to the lugs of the watch body, to connectors configured to provide a serpentine path for a single strap.

As can be discerned, this issue severely limits the ability of wristwatch owners to change the watch band for style, function, or comfort, and to change it back again, where such a change involves engaging a two-piece watch band for a one piece watch band, or the opposite.

The device herein provides watch band connectors which are engageable to the lugs or sides of a wristwatch body to an engaged position. So engaged, the connectors are configured to allow easy engagement, disengagement, and change out, of any single piece watch band or two-piece watch band formed of a first section and second section, to the same wristwatch body. The disclosed device allows for easy, yet highly secure watch band engagements thereby eliminating connection failures which may cause loss or damage of the wristwatch. As disclosed herein, the connector device is easily engaged to the wristwatch body. Once a pair of the disclosed connectors are so engaged, they provide the user the ability to quickly change between single piece watch band and two-piece watch bands formed of a first section and second section, at will, and quickly.

It should be noted, the foregoing examples of related art for watch band connectors and the like and limitations related therewith are intended to be illustrative and not exclusive, and they do not imply any limitations on the device and watch band system described and claimed herein. Various limitations of the related art are already known or will become apparent to those skilled in the art upon a reading and understanding of the specification below and the accompanying drawings.

An object of the present invention is the provision of a watch band connector adapted to easily engage opposing sides of a wristwatch body, which will thereafter enable easy engagement of either of a single piece watch band or a two-piece watch band formed of first and second sections, to the watch body.

Further objectives of the watch band connector invention herein will be brought out in the following parts of the specification wherein the summary and detailed description of the invention are for the purpose of fully disclosing the invention without placing limitations thereon.

SUMMARY OF THE INVENTION

The present invention provides a device and method solving shortcomings and dilemma in the art of the connection of single piece elongated watch band, or two-piece watch bands formed of a first section and second section, to the body or case of a wristwatch. As disclosed herein, the system provides a watch band connector allowing a user to employ either single piece watch band or a two-piece watch band formed of first and second sections. This novel design and function is provided using one connector operationally engaged on each side of the watch which once engaged, allows for such dual engagement.

Using a first end of the connector adapted to engage with the screw or engagement member of the watch, the engaged connectors enable the change out of single piece watch bands or two-piece bands formed in first and second sections, without requiring any physical change or re-formation of the connector in order to transition between either of the two types of watch band or strap options.

Additionally, the connector is configured when employed in the two-piece application engaging two sections of watch band, to provide an enhanced ease to the user to more easily and more rapidly install each of the sections of two-piece straps on opposing sides of the watch body. This enhanced function eliminates the unusually difficult and tricky step of positioning a conventional two spring bar pin having spring loaded tips, to an engagement within the openings in the lugs of the wristwatch.

The structure of the connector herein eliminates the need for the user to employ pins or compression tools currently required to collapse one or both ends of a spring bar, which is positioned in both ends connecting ends of both sections of a two-piece watch band. So positioned the compressing of the projecting pins must be accomplished prior to guiding both compressed pins between the watch lugs, while concurrently trying to hold the spring bar compressed. The need to then release the compressed spring bar to engage the opposing holes on the lugs of the watch body is also eliminated.

This need to multi-task multiple delicate operations to engage the watch band ends is eliminated by the provision of a novel groove communicating on opposing sides of the connector from the second or open end. The diameter of the opening along the opposing surfaces of the groove taper from a larger diameter to a narrower diameter adjacent the holes. The width of the groove also tapers from larger to narrower as it approaches the holes into which the pins engage. This concurrently provides alignment of both projecting distal ends of the small spring bar during travel along a defined path of the groove leading to an easy and positive capture of both the spring bar tips within the opposing holes in opposing sides of the connector. This action provides concurrent positioning of the annular spring bar shoulder flange against the respective sidewall surrounding the holes.

As a consequence, the delicate and maddening job of collapsing the ends of the very small spring bar and holding the two ends compressed within ends of the watch band, while concurrently aligning and attempting to engage the ends within the lug holes, is eliminated. A simple sliding of each of two sections of the two piece watch band engaged with a spring bar, along the tapering grooves in opposing sidewalls of the connector, will concurrently compress both pins and guide them directly to a positive engagement with both holes in the opposing sidewalls of the connector.

Additionally, and especially important for watches used in sports which are subject to dislodgement from movement and sharp contact with objects, the connector forms and provides a tertiary engagement of the watch band connection ends of each of the two sections in the two-piece band, in addition to the spring bar engagement. The tertiary engagement is provided by the adapter interior cross member contact with a bulbous portion formed on connection ends of each portion of two-piece band. This tertiary engagement of both connection ends of the two sections, in combination with the spring bar, significantly increases the force required to pull the band loose over a conventional spring bar only engagements.

For users who may subsequently wish to engage a single piece watch band, to a watch where the two sections of a two-piece band have been engaged, the connector herein provides an easily engaged serpentine pathway through passages in both connectors allowing the user to thread the strap therethrough and across the rear surface of the watch body. Thus, unlike conventional adapting connectors for watch bodies where new connectors would be required when changing watch band types, the device herein accommodates both types of bands eliminating the need to purchase new adapting connectors when changing band types.

With respect to the above description, before explaining at least one preferred embodiment of the herein disclosed watch band connector device and method in detail, it is to be understood that the invention is not limited in its application to the details of construction and to the arrangement in the following description or illustrated in the drawings. The watch band connector herein described is capable of other embodiments and of being practiced and carried out in various ways which will become obvious to those skilled in the art upon reading this disclosure. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other watch band connector devices, and for carrying out the several purposes of the present disclosed system. It is important, therefore, that the claims herein be regarded as including such equivalent construction and methodology, insofar as they do not depart from the spirit and scope of the present invention.

BRIEF DESCRIPTION OF DRAWING FIGURES

The accompanying drawings, which are incorporated herein and form a part of the specification, illustrate some, but not the only or exclusive examples of embodiments and/or features of the invention. It is intended that the embodiments and figures disclosed herein are to be considered illustrative rather than limiting.

DETAILED DESCRIPTION OF THE PREFERRED EMBODIMENTS OF THE INVENTION

Figure 1:
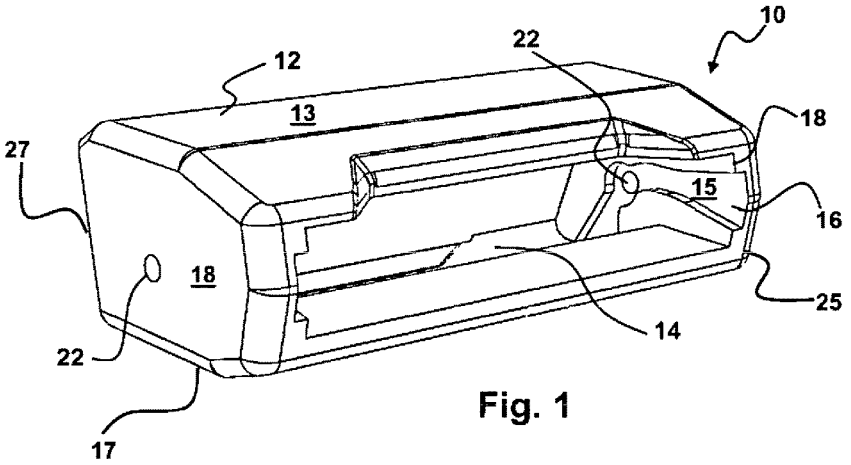
FIG. 1 is a perspective enlarged view of the watch band connector herein showing which is employed in pairs, with one each engaged to opposing sides of a wristwatch case, each having an opening communicating with a passage running between a second end of the connector and a lower surface thereby allowing for engagement of a connection end of one section of a two piece watch band to the wristwatch.

In this description, any directional prepositions if employed, such as up, upwardly, down, downwardly, front, back, first, second, top, upper, bottom, lower, left, right and other such terms referring to the device or depictions as such may be oriented, are describing it such as it appears in the drawings and are used for convenience only. Such terms of direction and location are not intended to be limiting or to imply that the device herein has to be used or positioned in any particular orientation.

Figure 4:
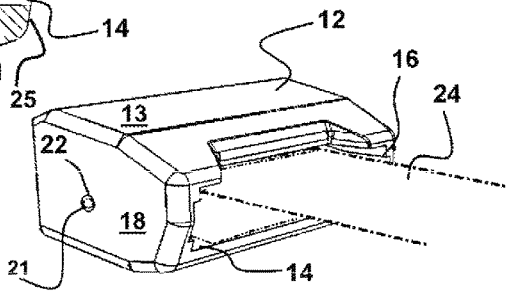
FIG. 4 shows a connection end of one section of a two-piece band, communicating into the opening to the passage through the body of each connector which would be engaged to a watch case.
Figure 5A:
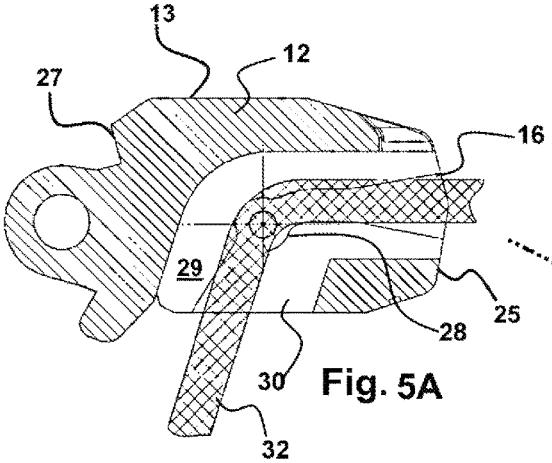
FIG. 5A shows the device as in FIG. 5, showing the single piece watch band following one half of the serpentine pathway of the passage provided through each connector for the single piece band.
Figure 5:
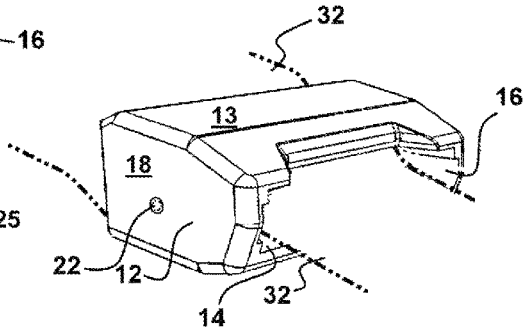
FIG. 5 depicts the device of FIG. 1, having a single piece watch band which would communicate along a serpentine pathway through a passage of a first connector, between second openings of the first and a second connector, and through the passage of a second connector engaged on the opposite side of the body of the watch.
Figure 6:
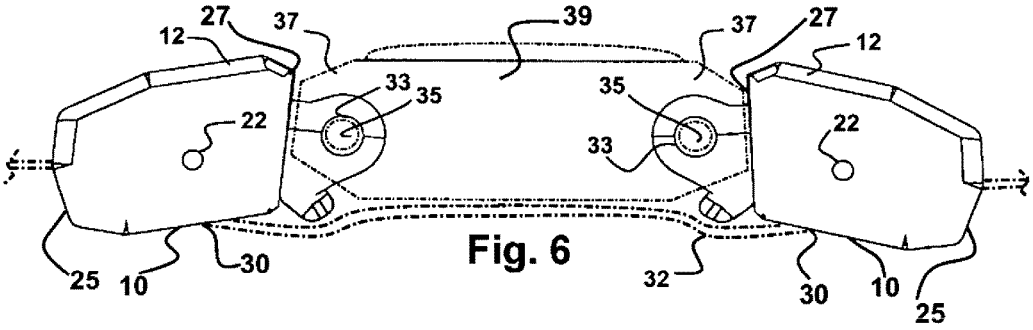
FIG. 6 shows a depiction the respective first ends of each of two connectors herein with first ends adapted for and engaged to the lugs extending on opposing sides of a watch shown in broken line.

Now referring to drawings in FIGS. 1-8, wherein similar components are identified by like reference numerals, there is seen in FIG. 1 a perspective enlarged view of the watch band connector 10, which is employed in pairs with one connector 10 each engaged to opposing lugs 37 extending from the sides of a wristwatch as in FIG. 6. As shown in FIG. 1, each connector 10 is formed with a body 12 and has an first opening 14 on a second end 25. The second end 25 is positioned opposite a first end 27 of each of the connectors 10 each of which is adapted for engagement to or between a pair of opposing lugs 37 (FIG. 6) which conventionally extend in such opposing pairs, from both sides of a wristwatch case 39 which houses a watch movement.

Figure 4A:
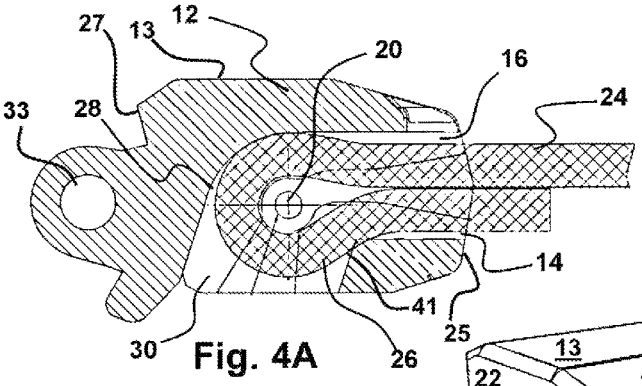
FIG. 4A is a sectional view of FIG. 4, showing the spring pin engagement in the hole of both sidewalls to hold the connection end of each section of the two-piece band, and showing a formed bulbous portion of each connection end forming a tertiary engagement of the connection end of the strap portion with the strap passage between the sidewalls of the connector.

As noted above and shown in the drawings, each body 12 of each connector 10, has a upper surface 13 opposite a lower surface 17 both extending between two opposing sidewalls 18. Inside each body 12 a passage 28 runs in-between the two opposing sidewalls 18 of the body 12. The passage 28 communicates from the first opening 14 on the second end, to a second opening 30 in the lower 17 surface (FIGS. 4A and 5A). This passage 28 and is adapted for operative engagement with each engagement end of the two sections of a two-piece watch band 24, or for passage therethrough of a single piece watch band 32 such as in FIG. 5A and FIG. 6.

Preferably, grooves 16 depend into corresponding positions, upon the sidewalls 18 on opposing sides of the passage 28. The grooves 16 depend a depth into the opposing sidewalls to form a recessed surface 15 in corresponding positions on both opposing sidewalls 18 within the passage 28.

While the connector 10 bodies 12 will work to secure either of two types of watch bands to a wristwatch case 39 without the grooves 16, the inclusion of these opposing grooves 16 is particularly preferred. Both grooves 16 correspond in their respective position on each opposing sidewall 18 such that they mirror each other. The grooves 16 have a width W (FIG. 2) defined by a diameter of the groove 16. This width W is largest at an intersection of each groove 16 with the first opening 14 on the second side of the body 12, and the width W tapers to a smaller diameter of each groove 16, adjacent opposing holes 22 in the sidewall 18. The holes 22 are configured to operatively engage the ends or spring loaded pins 21 of the spring bar 20 therein (FIG. 3).

Additionally, the distance between the two opposing recessed surfaces 15 of the opposing corresponding grooves 16 depending into each respective sidewall 18, tapers in the distance therebetween. This tapering shown best in FIG. 8, extends from a larger first distance D1 between the opposing recessed surfaces 15, where both opposing recessed surfaces 15 intersect the first opening 14, to a narrower second distance D2 between the opposing recessed surfaces 15 depending into the sidewalls 18, at or adjacent both respective holes 22 formed within the grooves 16 in both respective sidewalls 18.

While the body 12 of the connectors 10 will work well to allow either type of watch band to engage the wristwatch case 39, the tapering is preferred. This is because the tapering of the width between the recessed surfaces 15 of the two grooves 16, and the resulting decreasing distance between the two opposing recessed surfaces 15 as the grooves 16 approach the holes 22, defines a secondary pathway within the passage which narrows as it approaches the holes 22. This narrowing is configured for a sliding insertion of a spring bar 20 (FIG. 3) along the opposing grooves 16, from the first opening 14 toward the holes 22, to achieve operative engagement of the two end pins 21 of the spring bar 20 within formed holes 22.

Thus, the connector 10 body 12 so configured defines a compressive path for the ends of the spring bar 20 for compressing an subsequent engagement of the two spring loaded projecting ends of the spring bar 20 into the holes 22, without any tools. This may be accomplished while the spring bar 20 is engaged with a wrapped connection end of the (FIG. 4A) watch band 24, which is then slid along the path of the opposing grooves 16 in corresponding positions in both sidewalls 18, while both ends of the spring bar contacting one of the recessed surfaces 15 in each respective groove 16.

Engaged in this compressive pathway during a sliding along in the grooves 16, both projecting portions 21 or ends of the spring bar 20 are thereby compressed by contact with and the decreasing distance between, the two recessed surfaces 15. Further, the narrowing of the width of both grooves 16 concurrently acts as a funnel or guide for the translating spring bar 20 with the band 24 wrapped around it as in FIG. 4A, such that the projecting portions 21 of the spring bar 20 are guided to engagements with the holes 22, without the user needing to view the progression of the spring bar 20 during the procedure which is normally required and conventionally takes good vision or magnifying lenses.

This engaged configuration is shown in FIG. 4*a*, which shows the spring bar 20 engaged through each connection end of each section forming the two piece band 24, and with both projecting ends of the spring bar 20 engaged in the holes 22. Also shown is the tertiary engagement 41 of a formed bulbous portion 26 of the connection ends of the sections of the watch band 24. This bulbous portion 26 forms as the watch band 24 wraps around the spring bar 20, secured within a taller second portion 29 the passage 28 formed by and communicating from the second opening 30 to the passage 28.

This tertiary engagement 41 occurs after the end of the band 24, wrapped around the spring bar 20, has been pushed through a shorter first portion 31 of the passage 28 between a top and bottom surface of the passage 28 located at the first opening 14. The passage 28 runs to a larger or taller second portion 29 aligned with the second opening 30. Thus as the folded connection ends of each section forming a two-piece band such as in FIG. 4A, are pushed into the first opening 14 at the narrower or shorter first portion 31 of the passage 28, the bulbous portion 26 is compressed. Once the bulbous portion 26 reaches the taller or second portion 29 (FIG. 5A) of the passage 28, the bulbous portion 26 decompresses to a size larger than the distance of the shorter first portion 31 of the passage 28 shown in FIG. 4A.

Still further, a secondary capture/retention methodology may also be provided in addition to that of the tip of the spring bar 20 in the hole 22 on the sidewall 18 surrounding the hole 22. In this secondary retention mode, a positive capture and retention of the spring bar 20 is further enhanced through a secondary engagement where a flange 21A (FIG. 3) at the ends of the spring bar 20 operatively engages within a concentric annular recession 23 depending into the sidewall 18 and surrounding hole 22, as shown in FIG. 2.

Figure 2:
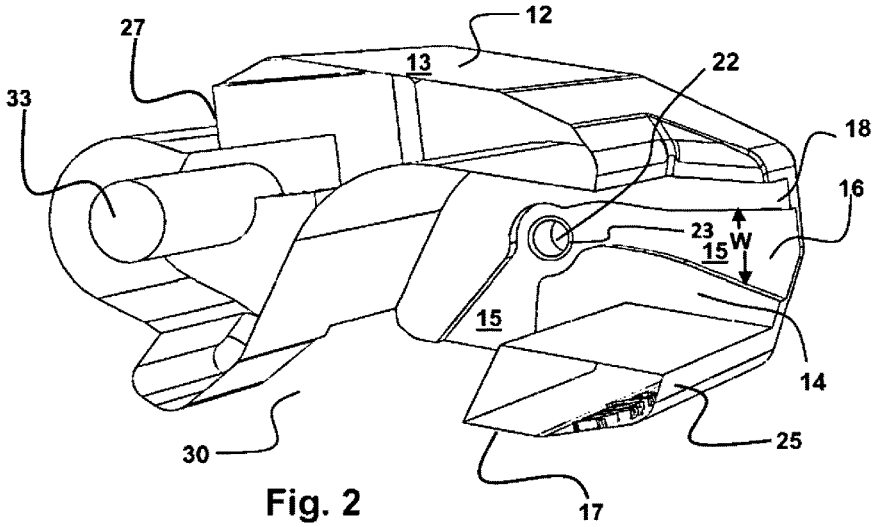
FIG. 2 depicts a sectional view through a connector of FIG. 1, showing one sidewall and the holes for engagement of spring pins and the preferred tapering opposing groove in the sidewall configured to compress and guide the spring pins of the spring bar to operative engagement with the holes.
Figure 3:
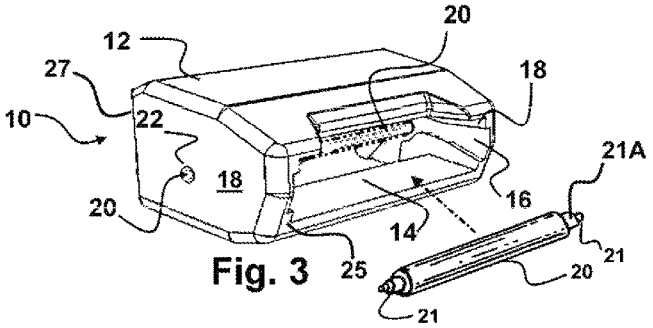
FIG. 3 is a depiction of a connector device of FIG. 1 showing a spring bar which is engageable with connection ends of each section of a two-piece watch band and with opposing holes depending into opposing sidewalls within the opposing sidewalls of the passage, preferably within corresponding grooves in the opposing sidewalls as would be where sections of the two-piece watch band are engaged.

Also shown in FIG. 2, is the perspective sectional view through the body 12 of the connector 10 such as in FIGS. 1 and 3. In this view, the spring bar holes 22 can be seen at the narrowest point of separation between tapering recessed surfaces 15 of the two opposing grooves 16. As noted, FIG. 3 shows the connector 10 of FIG. 1 with a spring bar 20 having both spring loaded tips, engaged with the holes 22 at this narrowed position along and between the opposing recessed surfaces 15 of the two grooves 16 defining a ramp.

In FIGS. 4 and 4A as noted, there is shown one section of a two-piece band 24 communicating through the passage 28 from the first opening 14 of the body 12 of the connector 10. As shown, the bulbous portion 26 has decompressed to a size exceeding the height of the shorter first portion 31 of the passage 28. With the spring bar 20 engaged through a loop at the engagement end of the section forming the two piece watch band 24, that connection end is held in position by the spring bar 20 engaged with the holes 22 in the sidewalls 18. Additionally, the connection ends of each section forming the two piece watch band 24, are held in engagement with the connector 12 by a tertiary engagement 41 (FIG. 4A) within the passage 28 as shown formed by the bulbous portion 26 at each connection end of each section forming the two piece strap 24 having expanded to a diameter wider than the shorter first portion 31 of the passage 28.

As noted, the first end 27 of the body 12 of each connector 10, on the opposite side from the second end 25 having the first opening 14, is adapted for engagement with the case 39 holding a movement of a wristwatch such as in FIG. 6. An axial passage 33 is shown in FIGS. 4A, 5A, and 6, adapting the first end 27 of the body 12 as an example of such an engagement, where a screw or pin 35 runs through the axial passage 33 and engages lugs 37 (FIG. 6) on the case 39 of the wristwatch in a conventional fashion which is well known.

FIGS. 5 and 5A depict the body 12 of each connector 10 having a single piece watch band 32 communicating through the passage 28, formed between the two sidewalls 18 of the body 12 of the connector 10. As noted this passage 28 curves and runs from the first opening 14 to the second opening 30. Shown in FIG. 6 is the serpentine pathway formed for a single piece watch band through each passage 28 of both connectors 10 which is followed by a single piece watch band 32 through the depicted body 12 of each connector 10 and in-between both by exiting the second opening 30 of one connector and re-entering the second opening 30 of the other connector 10, after passage adjacent the watch case 39 therebetween.

In use, in operative engagement of either type of watch band to a watch case 39, one connector 10 is positioned and operatively engaged on both sides of a watch case 39 as shown in the depiction in FIG. 6. In such a typical engagement, two of the connectors 10 herein each having first ends of the body 12 adapted for engagement to the case 39 are connected thereto such as with the lugs 37 extending on opposing sides of a watch case 39 and using a pin 35 or screw or the like.

In this configuration as noted, the watch can be engaged with either a single piece elongated band 32 which follows the serpentine path formed by both passages 28 in the body 12 of both connectors 10 and across a back surface of the watch case 39, or, a two-piece band 24 can be engaged. Where the two piece band 24 is engaged, one connection end of each of the sections forming the two-piece band 24 is engaged within the passage 28 in the body 12 of each connector 10 as depicted in FIG. 4A, where the spring loaded ends of the spring bar 20 seat into the holes 22.

Figure 7:
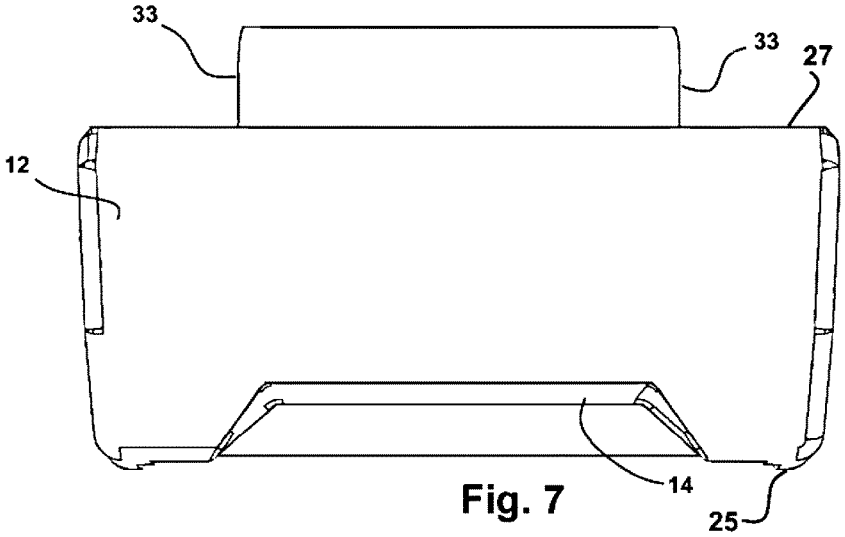
FIG. 7 shows a top view of one connector device herein showing the first end adapted for engagement between the lugs of a wristwatch, and the opening on the second end for communication of a strap into engagement with or through the connector.

In FIG. 7 is shown, a top view of an upper surface 13 of each body 12 of each of the connectors 10 herein. As shown, the axial passage 33 adapts the first end 25 of the body 12 of each connector 10 for engagement to one side of a watch case 39, such as in FIG. 6, although the first end 27 can be adapted for other engagements depending on the configuration of the watch case 39. Also shown, is the first opening 14 at the second end 25 of the body 12 for communication of either the single piece watch band 32 or one section of the two piece watch band 24 therethrough and into the passage 28.

Figure 8:
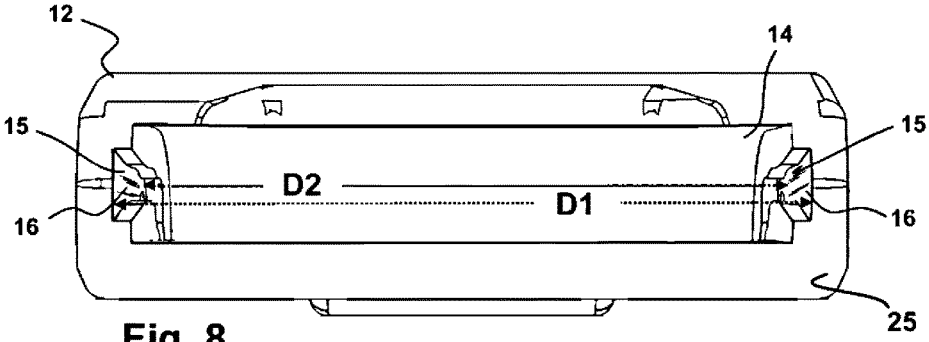
FIG. 8 shows a view of the first opening on the second end of the connector herein, and showing a preferred tapering of the width between both sidewalls by tapering the depth of the grooves in both sidewalls thereby providing the tapering of distance between the surface of the opposing grooves as they approach holes in each sidewall.

Finally, as noted in FIG. 8 is shown the first opening 14 communicating with the passage 28 at the second end 25 of the body 12 of the connector 10. As can be seen, the distance between the opposing corresponding recessed surfaces 15 defining the depth of both grooves 16 into opposing sidewalls 18, decreases from a larger distance D1 at or adjacent the first opening 14, to a narrower distance D2 at or adjacent the holes 22. As also can be seen, the width W (FIG. 2) of the grooves 16 decreases from a wider width at the intersection with the first opening 14 to a narrower width at or adjacent the holes 22.

While all of the fundamental characteristics and features of the watch band connector system and method herein have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that upon reading this disclosure and becoming aware of the disclosed novel and useful connector and system herein disclosed, that various substitutions, modifications, and variations may occur to and be made by those skilled in the art, without departing from the spirit or scope of the invention. Consequently, all such modifications and variations and substitutions, as would occur to those skilled in the art are considered included within the scope of the invention as defined by the following claims.

What is claimed is:

1. A wristwatch strap connector comprising:

a pair of connectors; each connector having a body, each said body having a first end adapted for engagement to one side of a wristwatch case; each said body having a second end opposite said first end; each said body having an upper surface and a lower surface extending in-between a pair of opposing sidewalls of said body; each said body having a watch band passage extending through said body between a first opening on said second end of said body, to a second opening on said lower surface of said body; each said body having a first hole formed into a first of said opposing sidewalls within said watch band passage; each said first hole in a corresponding position to a second hole formed into a second of said opposing sidewalls; each of said connectors engageable with a respective spring bar having opposing ends engaged with a respective first hole and second hole; each of said pair of connectors engageable with one section of a two section watch band by an engagement of a respective connection end of each of said sections, with a respective spring bar; and each of said pair of connectors additionally engageable with a single piece watch band by positioning of said single piece watch band along a serpentine pathway extending from said first opening through said watch band passage to said second opening on a first connector of said pair of connectors, from said second opening on said first connector to said opening on a second connector of said pair of connectors, and from said second opening on said second of said connectors through said watch band passage on said second connector to said first opening on said second connector, wherein said first of said opposing sidewalls having a first groove depending therein to a recessed surface, said first groove extending from said first opening to a first intersection with said first hole; said second of said opposing sidewalls having a second groove depending therein to a second recessed surface, said second groove extending from said first opening to second intersection with said second hole; said first groove being in corresponding position on said first sidewall to said second groove depending into said second sidewall; a distance between said first recessed surface of said first groove and said second recessed surface of said second groove, tapering from a widest said distance between said first recessed surface and said second recessed surface adjacent said first opening, to a narrower said distance between said first recessed surface and said second recessed surface adjacent said first hole and said second hole respectively; and whereby said tapering of said distance between said first recessed surface and said second recessed surface define a compressive pathway for compressing projecting portions of said spring bar during translation of said spring bar toward said first hole and said second hole while engaged at opposing ends in said first groove and said second groove.

2. The wristwatch strap connector of claim 1, additionally comprising:

a second portion of said watch band passage adjacent said first hole and said second hole, being taller than a first portion of said watch band passage adjacent said first opening;

and an expansion of each engagement of a respective connection end of each of said sections forming said two section watch band, while engaged with a respective spring bar concurrently forming a tertiary engagement of said connection end within said taller end of said watch band passage.

3. The wristwatch strap connector of claim 1, further comprising a concentric annular recession depending into each of the opposing sidewalls surrounding the first and second holes, the concentric annular recession operable to receive a flange at ends of the spring bar.

4. The wristwatch strap connector of claim 1, wherein each said body is adapted at a respective said first end thereof for a said engagement to a said wristwatch case by having an axial passage at said first end where said axial passage is sized for positioning of a pin engaged between lugs of said wristwatch case, therethrough.

5. The wristwatch strap connector of claim 2, wherein each said body is adapted at a respective said first end thereof for a said engagement to a said wristwatch case by having an axial passage at said first end where said axial passage is sized for positioning of a pin engaged between lugs of said wristwatch case, therethrough.

6. The wristwatch strap connector of claim 3, wherein each said body is adapted at a respective said first end thereof for a said engagement to a said wristwatch case by having an axial passage at said first end where said axial passage is sized for positioning of a pin engaged between lugs of said wristwatch case, therethrough.

7. A wristwatch strap connector comprising:

a pair of connectors; each connector having a body, each said body having a first end adapted for engagement to one side of a wristwatch case; each said body having a second end opposite said first end; each said body having an upper surface and a lower surface extending in-between a pair of opposing sidewalls of said body; each said body having a watch band passage extending through said body between a first opening on said second end of said body, to a second opening on said lower surface of said body; each said body having a first hole formed into a first of said opposing sidewalls within said watch band passage; each said first hole in a corresponding position to a second hole formed into a second of said opposing sidewalls; each of said connectors engageable with a respective spring bar having opposing ends engaged with a respective first hole and second hole; each of said pair of connectors engageable with one section of a two section watch band by an engagement of a respective connection end of each of said sections, with a respective spring bar; and each of said pair of connectors additionally engageable with a single piece watch band by positioning of said single piece watch band along a serpentine pathway extending from said first opening through said watch band passage to said second opening on a first connector of said pair of connectors, from said second opening on said first connector to said opening on a second connector of said pair of connectors, and from said second opening on said second of said connectors through said watch band passage on said second connector to said first opening on said second connector; and a second portion of said watch band passage adjacent said first hole and said second hole, being taller than a first portion of said watch band passage adjacent said first opening; and an expansion of each engagement of a respective connection end of each of said sections forming said two section watch band, while engaged with a respective spring bar concurrently forming a tertiary engagement of said connection end within said taller end of said watch band passage.

8. The wristwatch strap connector of claim 7, additionally comprising:

said first of said opposing sidewalls having a first groove depending therein to a recessed surface, said first groove extending from said first opening to an first intersection with said first hole; said second of said opposing sidewalls having a second groove depending therein to a second recessed surface, said second groove extending from said first opening to second intersection with said second hole; said first groove being in corresponding position on said first sidewall to said second groove depending into said second sidewall; a distance between said first recessed surface of said first groove and said second recessed surface of said second groove, tapering from a widest said distance between said first recessed surface and said second recessed surface adjacent said first opening, to a narrower said distance between said first recessed surface and said second recessed surface adjacent said first hole and said second hole respectively; and whereby said tapering of said distance between said first recessed surface and said second recessed surface define a compressive pathway for compressing projecting portions of said spring bar during translation of said spring bar toward said first hole and said second hole while engaged at opposing ends in said first groove and said second groove.

9. The wristwatch strap connector of claim 8, additionally comprising:

a second portion of said watch band passage adjacent said first hole and said second hole, being taller than a first portion of said watch band passage adjacent said first opening; and an expansion of each engagement of a respective connection end of each of said sections forming said two section watch band, while engaged with a respective spring bar concurrently forming a tertiary engagement of said connection end within said taller end of said watch band passage.

10. The wristwatch strap connector of claim 7, wherein each said body is adapted at a respective said first end thereof for a said engagement to a said wristwatch case by having an axial passage at said first end where said axial passage is sized for positioning of a pin engaged between lugs of said wristwatch case, therethrough.

11. The wristwatch strap connector of claim 8, wherein each said body is adapted at a respective said first end thereof for a said engagement to a said wristwatch case by having an axial passage at said first end where said axial passage is sized for positioning of a pin engaged between lugs of said wristwatch case, therethrough.

12. The wristwatch strap connector of claim 7, further comprising a concentric annular recession depending into each of the opposing sidewalls surrounding the first and second holes, the concentric annular recession operable to receive a flange at ends of the spring bar.

* * * * *